United States Patent [19]

Palanisamy et al.

[11] 4,452,726

[45] Jun. 5, 1984

[54] SELF-SEALING THERMALLY SENSITIVE RESISTOR AND METHOD OF MAKING SAME

[75] Inventors: Ponnusamy Palanisamy; Keith E. Ewing, both of Kokomo, Ind.

[73] Assignee: General Motors Corporation, Detroit, Mich.

[21] Appl. No.: 294,723

[22] Filed: Aug. 20, 1981

[51] Int. Cl.[3] ..... H01B 1/06

[52] U.S. Cl. ..... 252/518; 252/519; 29/612; 29/620; 338/22 R; 338/308

[58] Field of Search ..... 252/518, 519, 520, 521, 252/514; 29/610 R, 612, 620; 75/200, 221; 106/1.05, 1.23, 1.24, 47 R, 53, 54, 73.4, 73.5; 338/22 R, 308; 427/101, 102, 126.1, 126.2, 126.3, 126.6, 376.2

[56] References Cited

U.S. PATENT DOCUMENTS

| | | | |
|---|---|---|---|
| 3,928,243 | 12/1975 | Kudza et al. | 252/518 |
| 4,076,894 | 2/1978 | Langley et al. | 252/514 |
| 4,101,708 | 7/1978 | Larry | 252/518 |
| 4,312,770 | 1/1982 | Yu et al. | 252/519 |

*Primary Examiner*—Josephine Barr

*Attorney, Agent, or Firm*—Robert J. Wallace

[57] ABSTRACT

A thick film cermet thermistor having a low to moderate electrical resistivity but high resistance to abrasion and humidity is disclosed. The thermistor composition has a sintering aid and a sealing glass that soften at significantly different temperatures. The thermistor film is sintered after application to a substrate predominantly between the two softening point temperatures. Sintering temperature is raised above the higher softening point temperature long enough to glaze the thick film and bond it to the substrate but not long enough to substantially increase film resistance. A composition is disclosed that can be sintered under the same firing conditions for resistor and conductor films, permitting one firing to be used to sinter all three types of films.

7 Claims, No Drawings

SELF-SEALING THERMALLY SENSITIVE RESISTOR AND METHOD OF MAKING SAME

FIELD OF THE INVENTION

This invention relates to a thermally sensitive resistor, hereinafter referred to as a thermistor, of the thick film type and to a method of making such a thermistor. It more specifically relates to a thermistor composition and method for producing more durable thick film thermistors of lower resistivity.

BACKGROUND OF THE INVENTION

Thick film resistors, including thermistors, are ordinarily made by sintering a mixture of suitable semiconducting oxides and a vitreous binder onto a desired substrate. The semiconductive oxides provide a desired compound which provides a suitable chemical and/or physical structure that produces the predominant electrical characteristics of the film. The vitreous binder, i.e. a glass, enhances mechanical properties of the film and bonds it to an underlying substrate. It can also serve as an aid in sintering. In essence, a sintering aid is needed to obtain faster sintering at lower temperatures. Ordinarily only minor proportions of the sintering aid are needed to enhance sintering. Major proportions of it can deleteriously affect the film, as for example significantly raise electrical resistivity. However, sufficient vitreous binder must be present to provide resistance to both abrasion and environmental degradation. On the other hand, too much vitreous binder can cause resistivity of the film to be too high. For the foregoing reasons, it has been extremely difficult to form low resistance thermistor cermet thick films. In some instances, for example, for thermistors where very low resistance and high change in resistance with temperature is desired, it is not possible to obtain such a characteristic unless the glass content is kept so low that the film is no longer durable.

We have now found that a thermistor composition and method of making it that permits us to obtain both low resistivity and high durability. In addition, we have found a particular thermistor composition that provides these characteristics when normally co-fired with ordinary resistors and conductors.

OBJECTS AND SUMMARY OF THE INVENTION

An object of this invention is to provide a thick film printed resistor having a high durability without appreciable sacrifice in resistivity.

Another object of the invention is to provide an improved method of making a thick film resistor that has high resistance to abrasion and humidity without also having high electrical resistivity.

Still another object of the invention is to provide an improved composition for making sealed film thermistors of low resistivity and high stability.

A further object of this invention is to provide an improved cermet thermistor that can be co-fired with ordinary resistors and conductors, under the firing conditions normally used for firing those resistors and conductors and that this is readily useful with existing processes and equipment.

The invention comprehends a thermistor ink containing, by weight of solids therein, at least about 25% semiconductive oxides for providing predetermined electrical properties, about 5–30% by weight of a liquid phase sintering aid, and about 30–60% by weight of a sealing glass. The softening point temperature of the sealing glass is significantly above the softening point temperature of the sintering aid. The film is sintered predominantly at temperatures below the softening point temperature for the glass. However, during sintering, the sintering temperature is raised slightly above the softening point temperature of the glass for a time long enough to glaze the film but not long enough to significantly increase film resistivity.

DESCRIPTION OF THE PREFERRED EMBODIMENTS

This invention involves a thick film thermistor composition that is conveniently applied and fired and that has a low to moderate electrical resistivity and high resistance to abrasion and other environmental degradation. By thick film, we mean any film at least 1 micron thick. The thermistor is preferably made from a fluid, i.e. ink, having a unique solids composition dispersed in an ordinary vehicle. The solids-vehicle ratio may vary, depending on ordinary factors such as whether the fluid is to be applied by spraying, brushing, screening, etc. The fluid is dried after it is applied, to remove most if not all of its vehicle content. Any remaining vehicle, and any temporary organic binder used in the fluid is burned away during sintering, so that the resulting thermistor contains substantially only the solids content of the fluid from which it was formed.

The predominant electrical properties of the thermistor composition are obtained by including about 25–55%, preferably 30–50%, by weight, powdered semiconductive oxide in the solids content of the fluid mixture. The semiconductive oxide would generally be a complex chemical substance obtained from the chemical interaction of a plurality of oxides selected to produce desired electrical properties. The semiconductive oxide can thus be considered as a reaction product of a multiplicity of finely ground oxides. This reaction product can be produced during sintering of the thick film. In the alternative, it can be obtained by initially calcining the desired oxides before they are blended with the sintering aid, glass and vehicle. The reaction product would then be reground back down to the desired particle size, and blended with at least a glass and a vehicle, to form an ink. Previously calcining the oxides is normally not preferred. In any event, it is no more necessary, or even important, to precalcine the oxides when making our thermistor than it is when making any other thermistor. Hence, by semiconductive oxide, as used herein, we mean to include the raw oxides as well as the reaction product thereof.

One specific example of a semiconductive oxide powder that can be used to obtain a low resistivity of about 1.4 kiloohms per square per 0.001 inch of thermistor thickness and a beta of about 1360, by weight of solids in the ink and in terms of raw oxides, contains about 19% manganese oxide, about 13% copper oxide, about 4% cobalt oxide and about 10% ruthenium oxide. The manganese, copper and cobalt oxides can be prereacted, if desired, before mixing with the ruthenium oxide. If the manganese, copper and cobalt oxides are initially premixed, the premixture should contain, by weight, 54% manganese oxide, 36% copper oxide and 10% cobalt oxide. The solids content of the ink would then comprise 35% by weight of this premixture and 10% by weight ruthenium oxide for a total of 45%. On the other hand, the basic advantages of this invention are not attributable to the foregoing specific semiconductive oxides. The basic advantages of this invention should be obtainable with any other semiconductive oxide composition that is specifically tailored to provide a different specific resistivity and change thereof with temperature change (i.e. beta). By beta, we mean the product of the natural logarithm of the ratio of the low temperature resistance to the high temperature resistance times the product of the two temperatures in degrees Kelvin divided by the temperature difference in degrees Kelvin. In general, one should use, by weight of solids content, at least about 25% semiconductive oxide and usually not more than about 65%. However, a recitation of the semiconductive oxide content in the solids should not be emphasized. The more important feature of this invention resides in the sintering aid and sealing glass content.

About 5–30%, by weight of solids content, of a powdered sintering aid such as low softening point temperature glass is included in the mixture. At least about 5%, and preferably 10%, is needed in order to produce a sufficient liquid phase to adequately enhance the chemical interaction of the semiconductive oxide that is desired. On the other hand, more than 30% of the sintering aid can produce too high a resistivity in the resultant film. More than 30% will frequently produce too much gassing, that results in bubbles and a resultant undesired porosity in the resultant film. It may also tend to lower beta, particularly with semiconductor oxide mixtures containing ruthenium.

Any of the normal and accepted sintering aids used in other thick film resistor inks can be used in this invention. However, the particular sintering aid that is selected should provide a low viscosity liquid phase at a significantly lower temperature than the softening point temperature of the sealing glass. By low viscosity we mean a viscosity of about $1\times10$ to $1\times10^3$ pascal-seconds. Sintering aids are frequently glasses, and are not truly solids. Hence, they do not truly melt, i.e. change from a crystalline phase to a liquid phase. Accordingly, to avoid confusion we choose to refer to a softening point, rather than a melting point. The softening point will occur over a limited temperature range wherein the viscosity of the glass changes rapidly, and the glass no longer is self-supporting and tends to bend and flow. Even though we recognize this effect takes place over a few degrees of temperature, we still prefer to refer to it as a softening point, rather than a softening range.

Viscosity of a softened glass at its softening point is approximately $1\times10^{6.6}$ pascal-seconds. Immediately below its softening point, a glass will have a viscosity of about $1\times10^{12-13}$ or greater. We consider that the viscosity of a glass at its softening point, i.e. about $1\times10^{6.6}$ pascal-seconds, is a moderate viscosity. We believe that the sintering aid should have a low viscosity of about $1\times10$ to $1\times10^3$ pascal-seconds below the softening point temperature of the sealing glass to provide sufficiently rapid liquid phase sintering below the softening point temperature of a sealing glass. Viscosity at a given temperature is one rough measure of the effectiveness of a sintering aid. Not all sintering aids function the same at a given viscosity. Thus, a significant temperature difference is one that will allow the sintering aid to significantly enhance sintering below the softening point temperature of the sealing glass. A significant enhancement is one that allows total sintering time to be less than about 60 minutes, preferably less than about 45 minutes.

One sintering aid that can be used and which has been referred to as both a frit and a glass includes, by weight of the glass, 67% lead oxide, 8% boron oxide, 3% aluminum oxide and 22% silicon oxide. Such a glass has a softening point temperature of about 575° C. and a low viscosity at about 700°–800° C. On the other hand, any suitable sintering aid which will provide the desired low viscosity and/or significant sintering enhancement at a temperature below the softening point temperature of the sealing glass can be used. In general we believe a sintering aid-sealing glass softening point differential of at least about 150° C., and preferably about 250° C., is generally needed, as a practical matter.

The solids of the ink should contain at least about 30% by weight powdered sealing glass to provide a sufficiently effective glazing action on the resultant film during firing. By sufficiently effective, we mean readily notable increased resistance to both abrasion and humidity. Increased proportions of glass will provide increased resistance to abrasion and other environmental degradation. However, electrical resistivity will also increase. Generally we prefer to use less than about 50% sealing glass, and in no event more than 65%. It will be recalled we mentioned that higher proportions of sintering aid increase electrical resistivity too. The combined proportion of sintering aid and sealing glass ordinarily should be about 50–60% by weight. It should not exceed 65% by weight or electrical resistivity will simply be too high. However, in no event would we wish to use more than about 65% by weight sealing glass, even if only 5–10% by weight sintering aid would be used.

The basic advantages of this invention are believed to be due to substantially no chemical interaction by the sealing glass. Accordingly, we believe a sealing glass of any composition can be used, so long as it has a softening point temperature significantly higher than that of the sintering aid. On the other hand, one would also prefer that it have a coefficient of expansion as close as practicable to the substrate, for best thermal shock resistance. However, thermal expansion matching is not necessary to obtain the basic advantages of this invention. One preferred sealing glass is a commercially available silica glass containing some lead. It has a softening point temperature of about 825° C. and a thermal expansion coefficient similar to aluminum oxide. Hence, it is particularly useful on alumina substrates. Such a glass is identified as KE-691-C, available from Ferro Corporation, 7500 East Pleasant Valley Road, Independence, Ohio 44131. The glass KE-691-C is preferred over nonproprietary glasses having a similar softening point temperature because of its thermal expansion characteristics, and represents the best mode of practicing this invention.

The particle size of the semiconductive oxide, sintering aid and sealing glass are no more relevant in this invention than they are in any other thick film cermet resistor composition. For example, we prefer particle sizes of approximately 0.5–10 microns for the sintering aid and the sealing glass. The oxide powder is preferably as fine a particle size as can be conveniently handled, and in general not greater than about 0.5–10 microns.

The solid mixture as hereinbefore described is mixed with an appropriate amount of an organic vehicle to provide a fluid composition, i.e. ink or paste, that can be applied by a desired technique. In the present instance, we prefer to form the thick film thermistor coating by means of silk screening techniques. Consequently we prefer an ink containing about 75% by weight of the foregoing solids and about 25% by weight of an organic vehicle. The organic vehicle should preferably contain some form of an organic temporary binder, as for example ethyl cellulose. The majority of the vehicle can be of an organic solvent as for example terpineol which is essentially a high molecular weight alcohol. More specifically we prefer that the organic vehicle comprise by total weight ethyl cellulose and 95% by weight terpineol. Since the organic vehicle comprises 25% of the ink, there would only be about 1.25% by weight ethyl cellulose in the ink. Correspondingly, there would be only about 23.75% by weight terpineol in the ink.

The following is a specific example of the method of this invention. A mixture containing by weight 54% manganese oxide, 36% copper oxide and 10% cobalt oxide is prepared. 35 grams of this mixture is then blended with 10 grams ruthenium oxide, 15 grams of a sintering aid and 40 grams of a sealing glass. This forms a 100 gram mixture, to which is added 33 grams of an organic vehicle such as hereinbefore described. This mixture is then blended between rolls spaced apart about the distance of the largest particle size used in the mixture. After the mixture has been blended sufficiently, additional organic vehicle can be added if one is to use the ink for spraying, brushing or the like. However, we prefer to use only about 33 grams of the organic vehicle when applying the mixture to a substrate by silk screening techniques.

The mixture is then applied to an alumina substrate that has already been fired. A coating approximately 25 micrometers thick is applied in any desired pattern which will provide a predetermined electrical resistance for the resultant thermistor.

The alumina substrate is then dried in air at about 110° C. for about 10 minutes to evaporate the terpineol. Once the thick film coating is dry, the film can then be sintered to react the oxide, bond the film to the substrate and glaze the surface of the film.

To sinter the dried ink, the coated alumina substrate is placed in a belt furnace which heats the substrate from room temperature to 850° C. in 15 minutes. The alumina substrate is held at about 850° C. for 8 minutes and then cooled to room temperature in another 15 minutes. During the first 10 minutes of the 15 minute heating period the organic binder is being burnt away from the thick film. During the later stages of this initial heating period, and more specifically after the alumina substrate has been heated above 575° C., the oxides begin to sinter and inter-react to form the desired compounds which produce the desired electrical resistivity characteristics. The initial stages of this interaction is apparently completed before the film reaches the peak temperature of 850° C. Sintering clearly continues during firing at peak temperature and during initial parts of the second 15 minute period, i.e. cool down part of the cycle. The peak temperature during sintering is only slightly above the softening point of the sealing glass. Accordingly, the sealing glass does not lower in viscosity much below the softening point viscosity, which is about $1\times10^{6.6}$ pascal-seconds. Since the viscosity of the sealing glass is still fairly high, it does not readily interact with the oxides.

It should be understood, of course, that prolonged heating at a temperature even only slightly above the softening point of the sealing glass can eventually produce an adverse interaction, and an attendant adverse effect on the electrical properties of the film. Accordingly, the film is held at the peak temperature only long enough to glaze the film and bond it to the alumina substrate. In this example of the invention we prefer to hold the film at a peak temperature for about 5–10 minutes, preferably about 8 minutes. Cool down to room temperature can be performed satisfactorily in about 15 minutes which is probably about the maximum desired rate of cooling. Faster cooling probably can be used but would not be preferred. Analogously, slower cooling rates can be safely used. However, they are unnecessary, and may require that a lesser time than 8 minutes at peak temperature be used.

As previously indicated, in this invention the sealing glass softens enough to flow around the particles in the film and fill the voids to seal the entire thickness of the coating with only a very slight interference with the sintering process. As a result, film resistivity and temperature dependence of the film resistivity can remain substantially as provided by the semiconductive oxides and sintering aid. Thus, if the sintered semiconductive oxides can produce a low resistivity and high beta, it can be substantially preserved in the glazed resultant film. However, it should be recognized that prolonged heating and/or higher sintering peak temperatures would result in an increase in resistivity. In essence, the film should be heated long enough to soften, i.e. "melt", the sealing glass sufficiently to produce a glazed surface that can be visually observed. Once this glaze has been achieved, the film will be resistant to abrasion and stable when subjected to humidity testing. Any additional heating is unnecessary, and may tend to increase resistance of the film.

The particular semiconductive oxide, sintering aid, and sealing glass used in the foregoing specific example of this invention is especially significant for still another reason. The particular semiconductive oxides disclosed provide low resistivity and high beta. These characteristics are attained and preserved when the film is fired under the same conditions normally used for firing other resistors and conductors on the same alumina substrate. By properly relating the sintering aid and sealing glass, using the principles of this invention, we are able to fire our preferred thermistor composition at the same time the usual resistors and conductors are fired. Our thermistor thus need not be fired in a separate and special operation. Moreover, the particular sealing glass we have selected even has a coefficient of expansion to match that of an alumina substrate.

On the other hand, it should be understood that the concepts of this invention can be used with other sintering aids and sealing glasses, which have other softening point temperatures. A separate thermistor firing may be desired when using other sintering aids and/or sealing glasses. For use in this invention, the sintering aid need only have a softening point temperature which is sufficiently lower than the softening point temperature of the sealing glass to allow the sintering aid to be sufficiently lower in viscosity without softening the sealing glass, as previously mentioned. The particular heating time desired to reach peak temperature after melting the sintering aid, and cooling down from peak temperature, can obviously vary depending upon the difference between the softening point temperatures of the sintering aid and the sealing glass. As should be understood, the sintering aid promotes liquid phase sintering of the semiconductive oxides in the mixture. The lower the viscosity of the sintering aid at any given temperature, the faster sintering will proceed at that temperature. Thus, the lower in viscosity the sintering aid can go before the sealing glass softens, the lower the time needed to get adequate sintering before raising sintering temperature above the softening point of the sealing glass. It may even follow that less time at peak temperature can be used. However, we believe that at least about five minutes above the softening point of the sealing glass is usually needed, in order to get a satisfactory flow of the sealing glass.

Peak temperature used in firing the thermistor in accordance with this invention is preferably not greater than 50° C. higher than the softening point of the sealing glass. Otherwise, the viscosity of the sealing glass can be reduced to such a low value that the sealing glass will undesirably interact with the sintering aid and the semiconductive oxides. When this occurs, resistivity of the thick film mixture increases and resistance to abrasion and other environmental conditions will be reduced. The undesirable interaction can be reduced by simply shortening the time held at peak temperature, as for example heating above the softening point temperature of the sealing glass should probably be less than five minutes. However, the higher the temperature is increased over the softening point of the sealing glass, the shorter the time at peak temperature must be. When times become extremely short, control becomes increasingly difficult. Consequently, as a practical matter, we prefer to use peak temperatures which are only slightly above, i.e. about 25°-50° C., the softening point of the sealing glass.

The embodiments of the invention in which an exclusive property or privilege is claimed are defined as follows:

1. A method of making a sealed thick film thermistor having a low to moderate electrical resistivity comprising:

forming a mixture containing, by weight, at least about 25% semiconductive oxide powder, 5-30% of an inorganic sintering aid, and 30-60% of a powdered glass that has a softening point temperature significantly higher than the sintering aid for imparting abrasion and aging resistance to the oxide after sintering;

blending an organic vehicle with said mixture to form a fluid composition;

applying a film of said fluid composition to a refractory surface;

sintering the film predominantly below said softening point temperature to establish a desired film electrical resistivity and change therein with temperature change;

during sintering, and after acquisition of the desired electrical resistivity properties is assured, raising sintering temperature high enough to soften the powdered glass and allow it flow; and reducing sintering temperature below said softening point temperature before the flowed glass substantially interacts with the sintered oxides and/or sintering aid, effective to increase film abrasion and aging resistance without significantly adversely affecting film electrical resistivity properties.

2. A method of making a thick film thermistor having a low to moderate electrical resistivity that changes significantly with temperature change but also having a high resistance to abrasion and aging, said method comprising:

forming a powdered mixture containing, by weight, about 30-50% semiconductive oxide, 10-30% of a first glass, and 40-50% of a second glass that softens at a temperature at least about 150° C. higher than the first glass;

blending an organic vehicle with the mixture to form a fluid composition;

applying a film of said fluid composition to a refractory surface;

sintering the film to obtain a desired film electrical resistivity and change therein with temperature change;

during sintering and after acquision of the desired electrical resistivity properties is assured, raising sintering temperature high enough to soften the second glass; and reducing sintering temperature to harden the softened second glass before it significantly interacts with the sintered oxides and/or first glass, whereby it remains as a discrete phase to impart abrasion and aging resistance without substantially increasing film electrical resistance.

3. A fluid composition for making sealed film thermistors containing:

sufficient organic vehicle to apply the fluid composition by desired means; and a solids content comprising, by weight:

about 25-55% powdered semiconductive oxides for providing a predetermined electrical resistivity and change thereof with temperature change;

about 5-30% powdered sintering aid for significantly enhancing liquid phase chemical interaction of the semiconductive oxides below a softening point temperature of a sealing glass; and about 30-60% of a sealing glass having said softening point temperature for glazing a film of the interacted oxides without significantly increasing electrical resistivity properties attributable to the interacted oxides.

4. A fluid composition for making more durable thick film thermistors comprising a vehicle containing solids in the following proportions, by weight:

about 30-50% powdered semiconductive oxides for providing a predetermined electrical resistivity and change thereof with temperature change;

about 10-30% powdered first glass for enhancing liquid phase sintering of the oxides effective to produce a desired electrical resistivity in the powdered oxides and acquire a desired electrical resistivity change with temperature change;

about 50-60% of a second glass that melts significantly above the first glass, for fusion without substantial dissolution in the first glass, whereby the second glass can remain as a discrete phase in the film after sintering, that enhances durability of the film without significantly altering the aforementioned desired film resistivity properties.

5. A fluid composition for making sealed film thermistors comprising a vehicle containing the following mixture, by weight:

at least about 25% powdered semiconductive oxides for providing a predetermined electrical resistivity and change thereof with temperature change;

about 5-30% powdered first glass for significantly enhancing liquid phase sintering of the oxides at 700°-800° C. effective to establish a desired electrical resistivity in the powdered oxides and acquire a desired electrical resistivity change with temperature change; and about 30–60% of a second glass that softens and flows at about 825°–850° C. without rapid deterioration of said electrical resistivity and change thereof whereby the second glass can remain as a discrete phase in the film after sintering, to seal the film without significantly altering the aforementioned desired film resistivity properties.

6. A thick film printed thermistor having a low to moderate electrical resistivity, a significant electrical resistivity change with temperature change, and a high resistance to abrasion and environmental degradation, the film thermistor comprising by weight:

at least about 25% of a sintered semiconductive oxide mixture for providing predetermined electrical resistivity properties to the film;

about 5–30% of a sintering aid, reacted with the oxide mixture as from liquid phase sintering of the oxide mixture, effective to provide lower film resistivity and higher change thereof with temperature change; and about 30–60% of a second glass that has a softening point temperature significantly higher than the sintering aid, distributed as a separate phase throughout the sintered oxide, effective to make the film more resistant to abrasion and environmental degradation without significantly increasing film resistivity or decreasing the change thereof with change in temperature.

7. A glazed thick film printed thermistor comprising by weight:

about 25–55% of a sintered semiconductive oxide mixture for providing predetermined electrical resistivity properties to the film;

about 10–30% of a first glass, reacted with the oxide mixture as from liquid phase sintering of the oxide mixture, effective to provide lower film resistivity and higher change thereof with temperature change; and about 30–60% of a second glass that has a softening point temperature at least about 150° C. higher than the first glass, distributed as a separate phase throughout the sintered oxide and substantially unreacted therewith, effective to glaze the film without substantially degrading film electrical resistivity and change thereof with change in temperature that is attributable to the sintered semiconductive oxides.

* * * * *